US007056242B2

(12) United States Patent
Tsinberg

(10) Patent No.: US 7,056,242 B2
(45) Date of Patent: Jun. 6, 2006

(54) ACCURACY BACKBOARD

(76) Inventor: William Tsinberg, 9B-19 64th Ave., Apartment 8A, Rego Park, NY (US) 11374

( * ) Notice: Subject to any disclaimer, the term of this patent is extended or adjusted under 35 U.S.C. 154(b) by 187 days.

(21) Appl. No.: 10/613,572

(22) Filed: Jul. 3, 2003

(65) Prior Publication Data

US 2005/0003909 A1 Jan. 6, 2005

(51) Int. Cl.
*A63B 63/08* (2006.01)

(52) U.S. Cl. ..... 473/481; D21/701

(58) Field of Classification Search ..... 473/481, 473/415, 476, 478, 479; D21/698–706; D32/37
See application file for complete search history.

(56) References Cited

U.S. PATENT DOCUMENTS 3,137,502 A * 6/1964 Duganich ..... 473/481
D308,268 S * 5/1990 Phelps et al. ..... D32/37
4,984,787 A * 1/1991 Nesbit et al. ..... 473/481
5,346,207 A * 9/1994 Heinen ..... 473/481
6,196,938 B1 * 3/2001 Wiedner ..... 473/476
6,554,724 B1 * 4/2003 Taylor ..... 473/447
6,758,768 B1 * 7/2004 Spencer ..... 473/472

OTHER PUBLICATIONS

WebPage downloaded Oct. 13, 2005, HotShotSports, 2002, www.hotshot-sports.com/basketball.htm, 3 pages.*

* cited by examiner

*Primary Examiner*—Stephen Blau
*Assistant Examiner*—M. Chambers
(74) *Attorney, Agent, or Firm*—Jennifer Meredith; Meredith & Keyhani, PLLC

(57) ABSTRACT

The present invention provides an apparatus, with improved depth perception, focal line guidance, symmetry, extension, and spacial fixation on a goal or target. The primary purpose being to provide improved appeal and excitement to the game of basketball by providing improved long range shooting. According to a preferred embodiment, an improved accuracy backboard is disclosed comprising a backboard portion, a goal in fixed communication with the backboard portion and at least one stripe which provides a focal line tapering towards the goal so as to visually aid the player. The strip may be straight or wedge shaped and may be dramatic colors which may be similar to the color of the goal. The stripes may be symmetrically imprinted on the face of a backboard in a triangulating or surrounding axial formation to the goal. There may also be an outer concentric square and an inner concentric square.

7 Claims, 7 Drawing Sheets

ACCURACY BACKBOARD

BACKGROUND OF THE INVENTION

The present invention relates to backboard facings for ball games and, more particularly, to a basket wedge backboard that provides improved long range shooting thus increasing the appeal and excitement of the game.

The sport of basketball continues to be increasingly popular at different ages and levels of play. At all levels of play, one of the keys to success is the ability to make a high percentage of shots or "goals" and improved shooting accuracy is important. Generally, increased shooting accuracy is the result of hard work. Obviously, basketball backboards are well known within the art and generally consist of a standard flat dimensional backboard, background, or backstop having a generally squared off (sometimes rounded) shape. There is generally a white outer concentric square, or outline, and usually a smaller interior concentric square, in white or other color, or combination of colors, surrounding the general rim area.

One of the problems with conventional basketball backboard facings is that they do not provide optimal depth perception of the target, adequate focal line guidance and gathering to the target, and optimal symmetry, extension, and spacial fixation on the target. While prior art backboards provide some spacial orientation and symmetry on the target there is the need for increased spacial fixation and focal line guidance on the goal. One of the side effects of this is the low success rate for long-range shots (e.g. three point shots). As a result, there is defensive stagnancy and congestion near the basket. It would be desirable to provide a backboard with increased far shot accuracy, thus drawing defenders farther out to guard against a more effective outside shot. This would result in a level of excitement to the game that has yet to be achieved. Such a system would also create more exciting and potent inside offense, by way of opening driving and passing lanes, by spreading out defense in this manner.

There have been numerous attempts to provide improved accuracy within the sport. By way of example, U.S. Patent Application US2002/0119841A1, issued to Foley, discloses a Basketball training aid. The Foley Application discloses the use of a barrier over which a basketball shot must be lofted in order to pass through the basketball goal. The training aid is attached to the backboard. While such a system may provide improved accuracy, this requires installation and additional parts. As such, it is too complex and difficult to implement.

While prior art devices are suitable, they do not provide improved appeal and excitement that can be achieved by way of improved long range shooting. The main problem with conventional basketball backboard facings is that they do not provide optimal depth perception of the target. Another problem is they do not provide adequate focal line guidance and gathering to the target. Also, another problem is they do not provide optimal symmetry, extension, and spacial fixation on the target.

Accordingly, there is a need for an improved backboard that relaxes the shooter, improves accuracy, gives the shooter an improved sense of the basket's exact depth and distance in three dimensional space by way of vanishing points and lines of incline or descent, and finally, gives the shooter an improved sense of the basket's exact point of location on a two dimensional plane by way of guiding and gathering target triangulation and lines of extension. Such a system would increase the accuracy of outside shots.

Increased accuracy of outside shots, as an increased number of deep fly balls in a baseball game or long passes in a football game would provide an elevated level of grace and suspense to the spectator.

SUMMARY OF THE INVENTION

The present invention provides an improved backboard that provides increased accuracy for outside and long shots.

According to one embodiment of the present invention, an improved accuracy backboard is disclosed comprising a backboard, a goal in fixed communication with the backboard, and at least one stripe, wherein each stripe tapers towards the goal so as to visually aid the player.

According to another embodiment, an improved accuracy backboard apparatus is disclosed comprising: a backboard; a goal in fixed communication with the backboard; a left stripe, a top stripe and a right stripe, wherein the left stripe, the top stripe and the right stripe taper towards the goal so as to visually aid the player.

According to another embodiment, a method for providing an improved accuracy backboard for basketball is disclosed, comprising the steps of: providing a backboard, attaching a goal to the backboard and applying at least one stripe to the backboard, wherein the stripe(s) taper towards the goal.

These and other features, aspects and advantages of the present invention will become better understood with reference to the following drawings, description and claims.

BRIEF DESCRIPTION OF THE DRAWINGS

FIG. 8 is a perspective view of focal line scattering and 3-D penetration.

DETAILED DESCRIPTION OF THE INVENTION

The following detailed description is of the best currently contemplated modes of carrying out the invention. The description is not to be taken in a limiting sense, but is made merely for the purpose of illustrating the general principles of the invention, since the scope of the invention is best defined by the appended claims.

Figure 1:
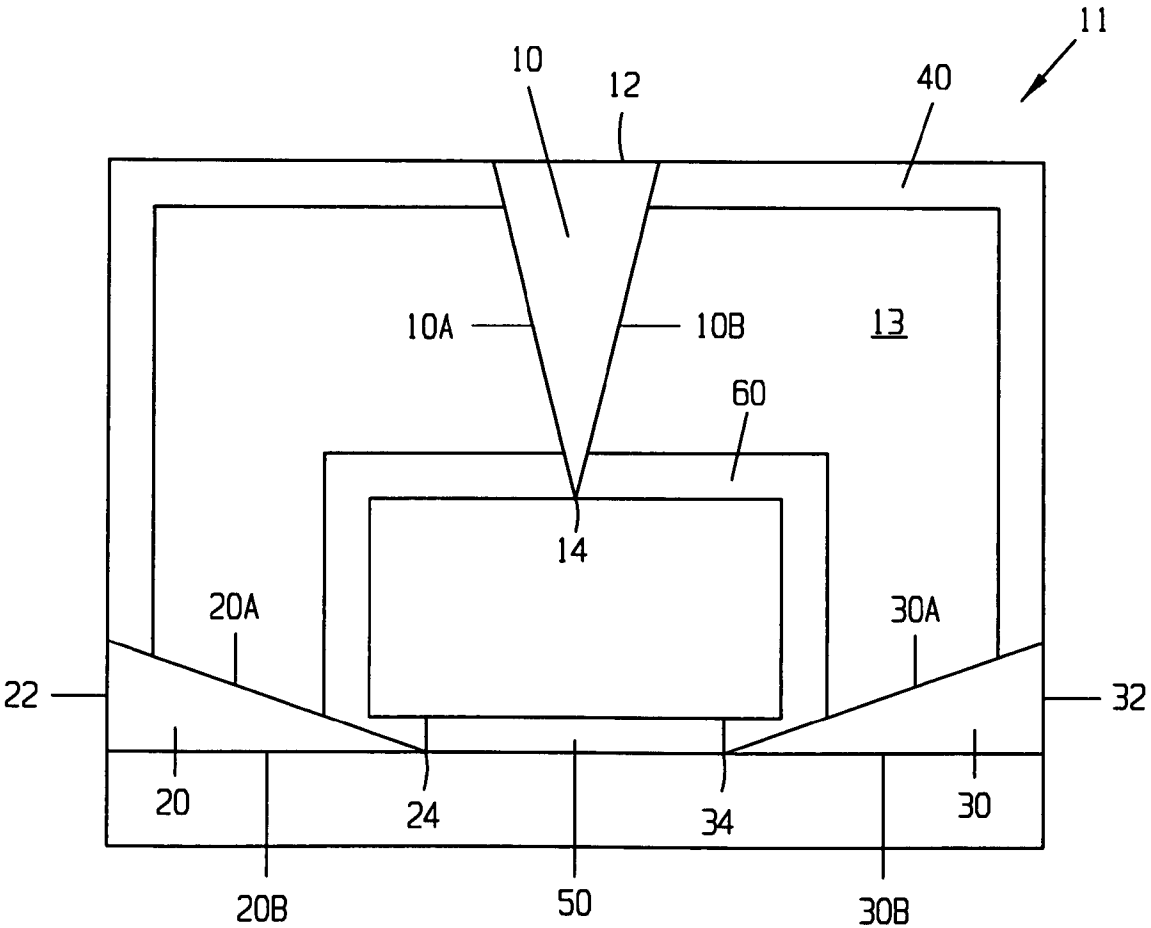
FIG. 1 is a front view of a preferred embodiment according to the present invention.

FIG. 1 is a front view of a basketball backboard according to the present invention. As depicted the backboard 11 provides increased accuracy and homing. There may be at least one stripe (e.g. 10, 20, 30). The stripe may be straight or wedge shaped and may be a variety of colors. According to a preferred embodiment there are three stripes. The stripes are preferably bold and taper towards the goal. According to the embodiment shown, the goal is a rim 50. The term tapering towards the goal is intended to mean that the stripes are narrower the closer they are to the goal.

The stripes are symmetrically imprinted on the face of a basketball backboard 11 in a triangulating or surrounding axial formation to the target area, which is a rim 50. The term backboard 11 is not meant in a limiting sense and the terms backboard, background, and backstop are interchangeable. There may also optionally be an outer concentric square 40 or outline of the same color or combination of colors. A top centered vertical axis stripe 10 of color is imprinted on the face 13 of the backboard 11, above the rim, with a preferable shape that has a symmetrical narrowing or tapering gradient in the direction of the rim 50. A left horizontal axis stripe 20 of color and being the mirror image of a right horizontal axis stripe 30, is imprinted on the face of the backboard 11 to the left of the rim 50, with a preferable shape that has a narrowing, descending, or tapering gradient in the direction of and toward the rim 50. A right horizontal axis stripe 30 of optional color, which is the mirror image of a left horizontal axis stripe 20, imprinted on the face 13 of the backboard 22, with a preferable shape that has a narrowing, descending, or tapering gradient in the direction of and toward the rim 50. The main components of the unit are lines of axis, or cross hairs 10, 20, 30, for the stripes, which are preferably either vertical or horizontal. The subcomponents of the unit are lines of convergence, or margin lines 10*a*, 10*b*, 20*a*, 20*b*, 30*a*, 30*b*, for each stripe, which are lateral to the lines of axis and preferably on a convergence gradient toward each other, as opposed to parallel, forming an additional wedge point subcomponent 14, 24, 34 pointed toward the rim.

The vertical axis stripe 10 is a centering line imprinted, length wise on a straight vertical axis, centrally situated with respect to the horizontal axis, and above the rim 50 on the face 13 of the backboard 11. It should be understood the stripes may be applied or painted by any methods or means known within the art or by such methods or means as are yet not known or anticipated. The vertical axis stripe 10, preferably has two ends, the top end 12 and the bottom end 14. The top end 12 typically and preferably extends at least to the existing outer concentric square 40 on the backboard 11. The bottom end 14 of the vertical axis stripe 10 should not extend below the existing interior concentric square 60 on the backboard 11. The width of the vertical axis stripe 10 is variable but should be of a reasonable nature and should be approximately the same width as the horizontal stripes (if such exist). The geometry of the line should also typically be symmetrical, with a left margin 10*a* and a mirror image right margin 10*b*, and the general shape of a wedge pointed downward toward the rim 50 or target area. A left horizontal axis stripe 20 of optional color, which is the mirror image of a right horizontal axis stripe 30, imprinted on the face of the backboard, background, or backstop to the left of the rim, with a preferable shape that has a narrowing, descending, or tapering gradient in the direction of and toward the target. The left horizontal axis stripe 20 is a lead line imprinted, length wise horizontally and generally to the left of the rim on the face of the basketball backboard, background, or backstop, by whichever method or means the presently existing lines are imprinted in the prior art or by such method or means as are yet not known or anticipated. The length of the line or axis 20, having two ends, may be variable in extending from the left edge of the backboard on the left end 22 of said line to the immediate left of the rim 50 on the right end 24 of said line but typically and preferably should extend at least to the existing outer concentric square 40 on the backboard on the left end of said line and should extend to approximately the immediate left of the rim on the right end of said line, and typically should equal the length of it's mirror image right horizontal axis stripe 30. The width of the line is variable but should be of a reasonable nature and typically should equal the width of the right horizontal stripe.

The geometry of the line may include an axis of any angle, excluding straight vertical, but should typically be in the shape of a ramp or incline with a horizontal axis, a horizontal bottom margin 20*b*, a diagonal center sloping top margin 20*a*, and overall in the general shape of a wedge pointed inward toward the rim or target area, but generally speaking the line may be of any symmetrical shape denoting a stripe, with margins of any design or gradient, in order to serve all or part of it's intended function. The color of the line is variable but preferably should be bold and complimentary to the color of the rim or target area in order to serve as a strong and congruous, or extending, component of the unit or circuit which the said component is a completion of, said service having the primary goal, being that congruity or color cohesiveness will tend to gather and not scatter focus, of, by described extension of target area, in somewhat similar fashion of a baseball glove gathering a baseball, aiding and facilitating in gathering focus to the desired area, and moreover the color preferably should not be variable from the other features or components of the invention if any, again with said aim of congruity. The left horizontal axis stripe 20 may be straight with parallel horizontal margins in which case it's function, among others, of enhancing depth perception may be lacking, though other functions, such as contributing to centering of target and triangulation, may still be served. The stripe, though preferred to be the approximate color of the rim and other components of the unit if any, may be of any color, sheen, texture, or such, as optimal color scheme is not the primary or defining sphere of the invention. Readily anticipated colors, however, would be white, gray, black, yellow, brown, blue, beige, green, orange, and red, or any shade or combination thereof. The stripe, if wedge shaped, may be, as stated, of any convergence gradient, though one that's typically and generally reasonable is preferred. The stripe may be of any width, though one as stated and as generally reasonable is preferred. The stripe may be of any length, though one as stated and as generally reasonable is preferred. The stripe may be situated on any axis, excluding straight vertical, though one as stated and as generally reasonable is preferred. The functional variations of the stripe, cumulative as stated, and generally primary to tertiary, are for 2 dimensional-plane horizontal centering of target, for depth sensory enhancement, for triangulation (see FIG. 2 and FIG. 4), for widening (see FIG. 5), and also for assisting in vertical plane location of the rim area when the rim itself cannot be seen. A right horizontal axis stripe 30 of optional color, which is the mirror image of a left horizontal axis stripe 20, imprinted on the face of the backboard, background, or backstop to the right of the rim, with a preferable shape that has a narrowing, descending, or tapering gradient in the direction of and toward the target. The right horizontal axis stripe 30 is a lead line imprinted, length wise horizontally and generally to the right of the rim on the face of the basketball backboard, background, or backstop, by whichever method or means the presently existing lines are imprinted in the prior art or by such method or means as are yet not known or anticipated. The length of the line or axis 30, having two ends, may be variable in extending from the right edge of the backboard on the right end 32 of said line to the immediate right of the rim 50 on the left end 34 of said line but typically and preferably should extend at least to the existing outer concentric square 40 on the backboard on the right end of said line and should extend to approximately the immediate right of the rim on the left end of said line, and typically should equal the length of it's mirror image left horizontal axis stripe 20. The width of the line is variable but should be of a reasonable nature and typically should equal the width of the left horizontal stripe. The geometry of the line may include an axis of any angle, excluding straight vertical, but should typically be in the shape of a ramp or incline with a horizontal axis, a horizontal bottom margin 30*b*, a diagonal center sloping top margin 30*a*, and in the general shape of a wedge pointed inward toward the rim or target area, but generally speaking the line may be of any symmetrical shape denoting a stripe, with margins of any design or gradient, in order to serve all or part of it's intended function. The color of the line is variable but preferably should be bold and complimentary to the color of the rim or target area in order to serve as a strong and congruous, or extending, component of the unit or circuit which the said component is a completion of, said service having the primary goal, being that congruity or color cohesiveness will tend to gather and not scatter focus, of, by described extension of target area, in somewhat similar fashion of a baseball glove gathering a baseball, aiding and facilitating in gathering focus to the desired area, and moreover the color preferably should not be variable from the other features or components of the invention if any, again with said aim of congruity. The right horizontal axis stripe 30 may be straight with parallel horizontal margins in which case it's function, among others, of enhancing depth perception may be lacking, though other functions, such as contributing to centering of target and triangulation, may still be served. The stripe, though preferred to be the approximate color of the rim and other components of the unit if any, may be of any color, sheen, texture, or such, as optimal color scheme is not the primary or defining sphere of the invention. Readily anticipated colors, however, would be white, gray, black, yellow, brown, blue, beige, green, orange, and red, or any shade or combination thereof. The stripe, if wedge shaped, may be, as stated, of any convergence gradient, though one that's typically and generally reasonable is preferred. The stripe may be of any width, though one as stated and as generally reasonable is preferred. The stripe may be of any length, though one as stated and as generally reasonable is preferred. The stripe may be situated on any axis, excluding straight vertical, though one as stated and as generally reasonable is preferred. The functional variations of the stripe, cumulative as stated, and generally primary to tertiary, are for 2 dimensional-plane horizontal centering of target, for depth sensory enhancement, for triangulation (see FIG. 2 and FIG. 4), for widening (see FIG. 5), and also for assisting in vertical plane location of the rim area when the rim itself cannot be seen. An outer square, or outline, of the same color as said stripes, running along the generally square or rounded off outer edge of the backboard, background, or backstop. The outer concentric square 40 is a stripe defining the general shape and margin of a square imprinted along the outer edge or margin of the face of a basketball backboard, background, or backstop, by whichever method or means the presently existing lines are imprinted in the prior art or by such method or means as are yet not known or anticipated. This square is highly optional and already exists in the prior art, with the sole substantial departure, though it may also depart with regards to width, being with respect to color, in that it should be of a congruous or identical color with other features or components of the invention, with the aim of completing a continual, cohesive, and unit defining visual circuit for the primary purpose of general focal orientation. The outer concentric square 40, which is not a main component of the invention, if at all, may be of any color, sheen, texture, or such, as optimal color scheme is not the primary or defining sphere of the invention, but typically and preferably should be in conformity with other features or components of the invention. Readily anticipated colors, however, would be white, gray, black, yellow, brown, blue, beige, green, orange, and red, or any shade thereof. The width of the stripe, which defines the outer concentric square 40, is variable but should be of a reasonable nature and may be of the reasonable width contained in the existing prior art.

Generally speaking the line may be of any symmetrical shape denoting a stripe, with margins of any design or gradient; in order to serve all or part of it's intended function. The color of the line is variable but preferably should be bold and complimentary to the color of the rim or target area in order to serve as a strong and congruous, or extending, component of the unit or circuit which the said component is a completion of, said service having the primary goal, being that congruity or color cohesiveness will tend to gather and not scatter focus, of, by described extension of target area, in somewhat similar fashion of a baseball glove gathering a baseball, aiding and facilitating in gathering focus to the desired area, and moreover the color preferably should not be variable from the other features or components of the invention if any, again with said aim of congruity.

The vertical axis stripe 10 may have a straight vertical axis with parallel vertical margins in which case it's function of enhancing depth perception may be lacking or limited, though other functions, such as 2 dimensional-plane horizontal centering of target and contributing to triangulation on the target, may still be served. The stripe, though preferred to be the approximate color of the rim and other components of the unit if any, may be of any color, sheen, texture, or such, as optimal color scheme is not the primary or defining sphere of the invention. Readily anticipated colors, however, would be white, gray, black, yellow, brown, blue, beige, green, orange, and red, or any shade or combination thereof. The stripe, having a straight vertical axis, and if wedge shaped by it's margins, may be, as stated, of any convergence gradient, though one that's generally reasonable is preferred. The stripe may be of any width, though one as stated and as generally reasonable is preferred. The stripe may be of any length, though one as stated and as generally reasonable is preferred.

Figure 2B:
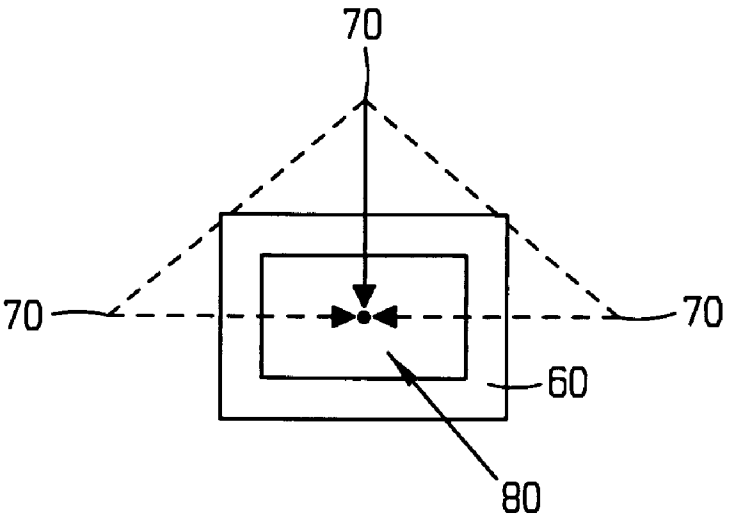
FIGS. 2A and 2B are perspective views depicting the focal triangulation cross hair principle.
Figure 2A:
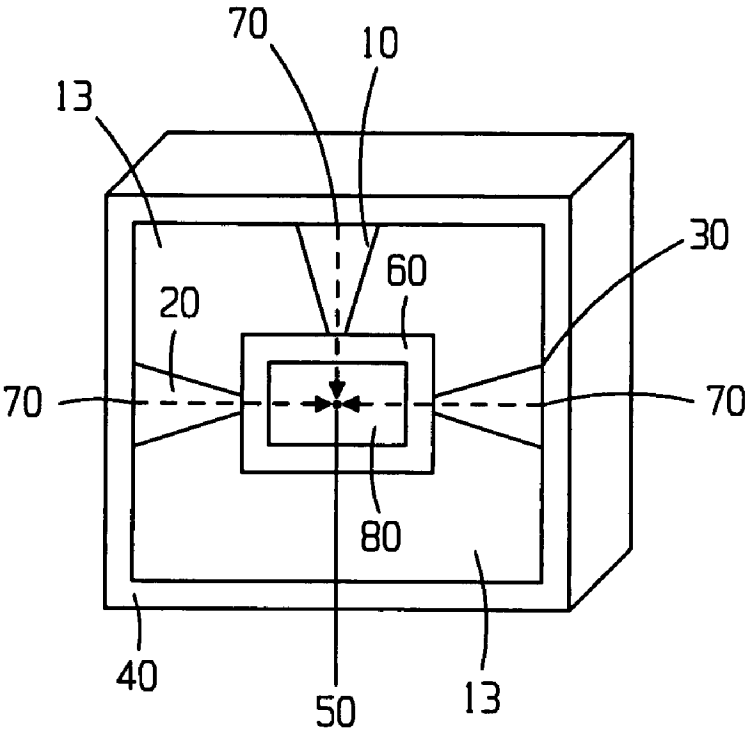

As shown in FIGS. 2 and 3, the functional variations of the stripe, are for 2 dimensional-plane horizontal centering of target, for depth sensory enhancement, for triangulation (see FIG. 2 and FIG. 3), and also for assisting in horizontal plane location of the rim area when the rim itself cannot be seen. As depicted in FIG. 2A, the shot originates from the shot source 70, directed towards the rim or goal 50, which represents the intended target. As the shot source 70, moves increasingly farther from the goal it is harder to focus on such a small target point. As the need for a larger target grows the target can shift to the backboard area within the inner concentric square 60, represented by 80. In the event that an even larger target area is needed the entire surface of the backboard 13, as outlined by the outer border 40 would become the target. As shown by the focal lines projecting form the shot source 70 to backboard, the stripes help to direct the attention of the shooter to the rim 50. As shown in FIG. 2B, there is the shot source 70, and the area on the face of the backboard 13, bounded by the inner concentric square 60.

Figure 3B:
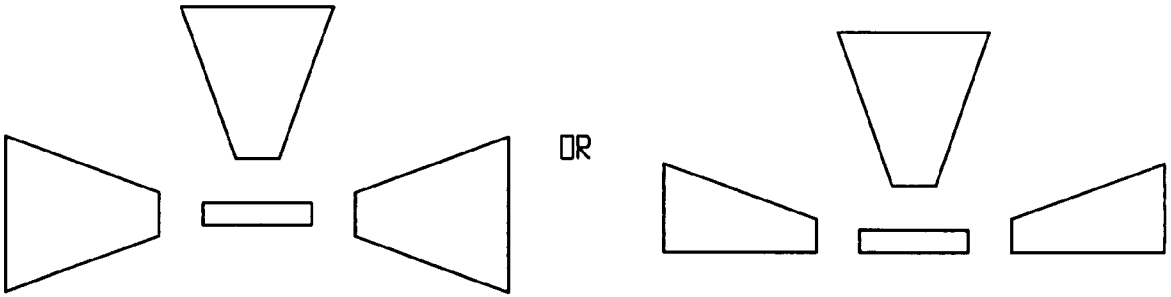
FIG. 3 depicts depth perception.
Figure 3C:
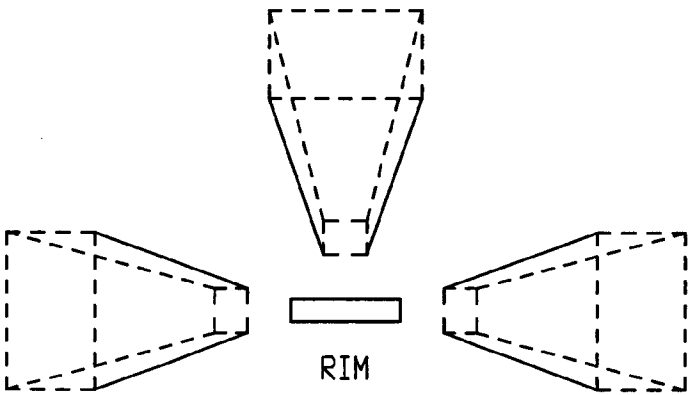
Figure 3A:
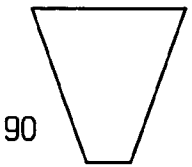

FIGS. 3A–3B are intended to depict the effect that stripes 10, 20 and 30 may have. FIG. 3A depicts a cross hair stripe 90. A cross hair stripe 60 that converges on the target, as depicted in FIG. 3B, provides the optical depth illusion as depicted in FIG. 3C. This provides a depth sensory aid and lends a third dimension of focus.

Figure 4A:
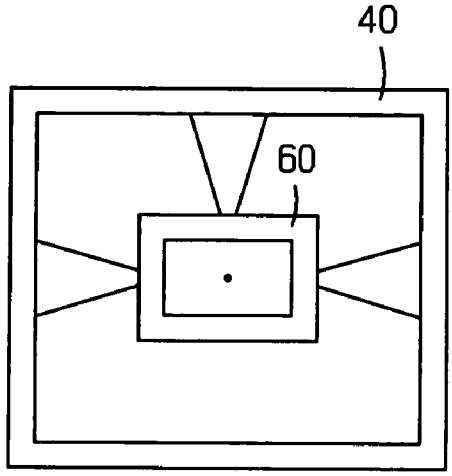
FIG. 4 is a front view of a representation of tapering and triangulation effects.
Figure 4B:
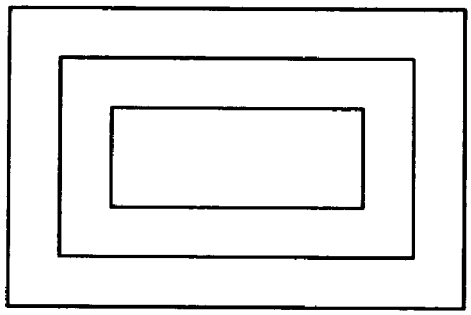
Figure 4C:
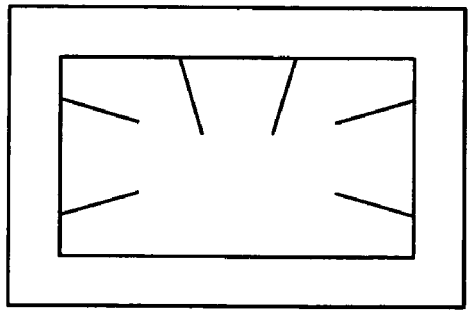

FIGS. 4A–4C depict the effect the outer concentric strip 40 combined with the stripes may have on the player. As shown, there may be an inner concentric square 60, outer concentric square 40, stripes 10, 20 and 30. The combination of the stripes (10, 20 and 30) and the squares (40, 60) is to provide a tapering concentric effect as shown in FIG. 4B. Also, as shown in FIG. 4C, this provides a tapered triangulation effect.

Figure 5B:
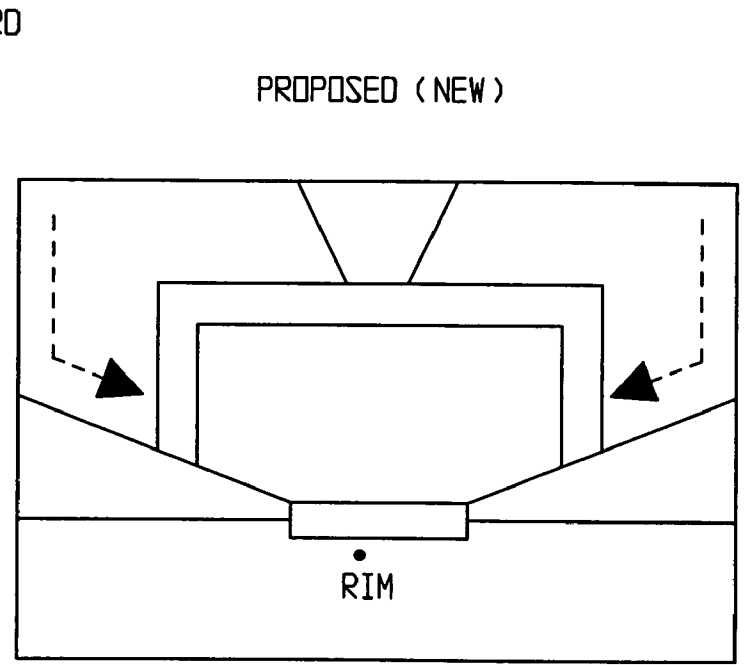
FIG. 5 is a front view of a representation of invention where the target widening effect of ramp lines is illustrated.
Figure 5A:
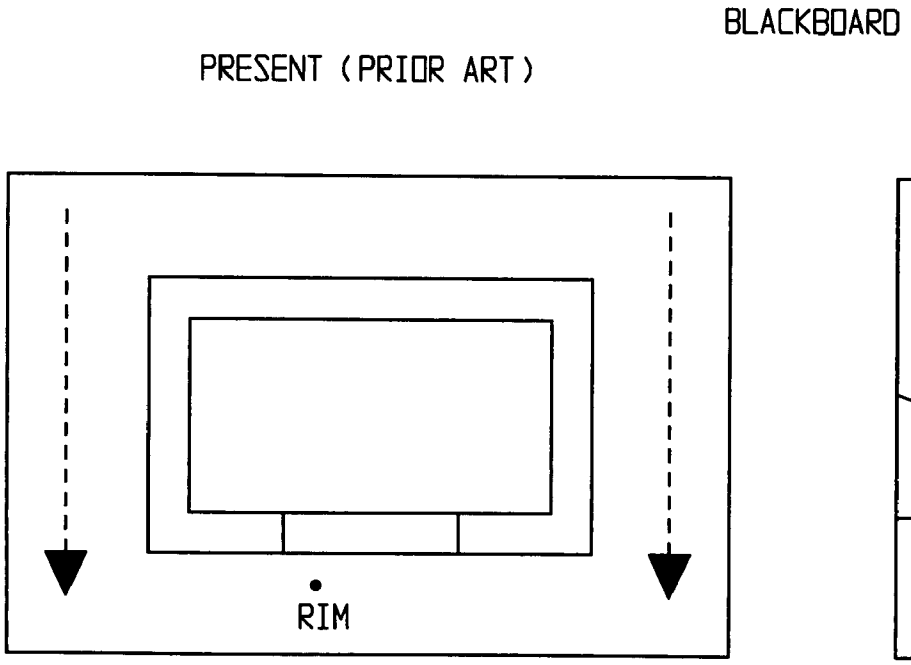

FIGS. 5A and 5B depict a preferred embodiment according to the present invention and how this design differs from the commonly used design. As shown, the top stripe 10 may be a trapezoid. The left stripe 20 and right stripe 30 may be triangular and taper into the rim. This provides the illusion of a wider target objective and relaxes the shooter, thereby improving shooting accuracy. The player is shooting to the wedges, not so much the basket. This effect is increased if the stripes are the same color as the rim, or bold in color.

Figure 6A:
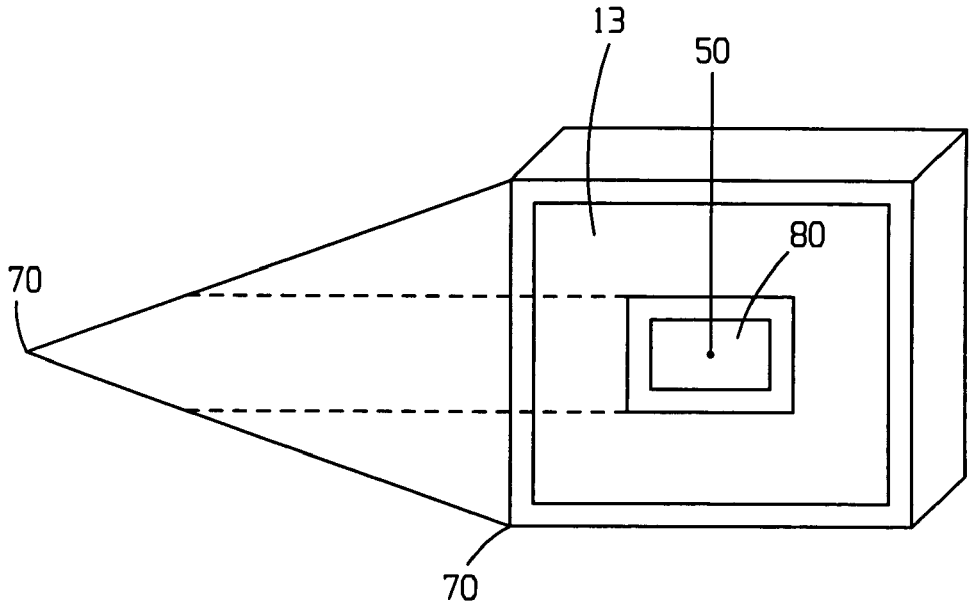
FIG. 6 is a perspective view of the focal tapering concentric principle.
Figure 6B:
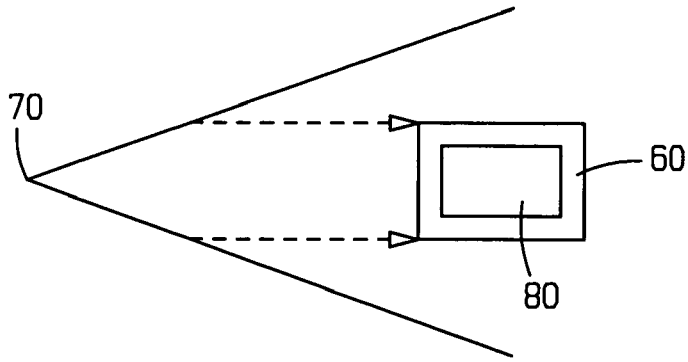

The functional variations of the square are to concentrically aid in focal line tapering onto the target (as illustrated in FIG. 6) to aid in visually unifying the rim 50, as the main target point with the surface of the backboard 13, it's greater target area, and to aid in visually fixing the greater target area in relation to it's greater, overall setting. FIG. 6A illustrates how a concentric field causes focal lines to incrementally taper or phase in on the ultimate target, the rim 50, from a broader target, the face of backboard 13. FIG. 6B illustrates this same principle on a smaller scale, more specifically focusing on the area on the face of the backboard 13 within the inner concentric square 60, indicated as 80.

Figure 7B:
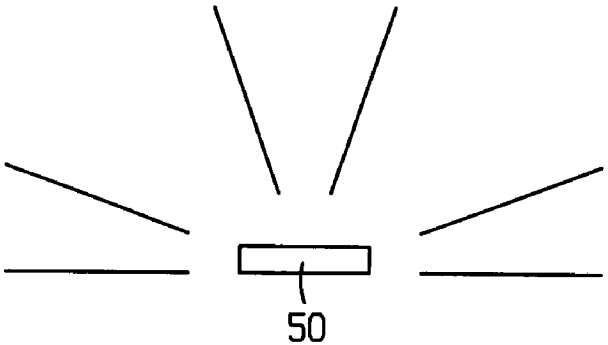
FIG. 7 depicts triangulating linear accumulation.
Figure 7C:
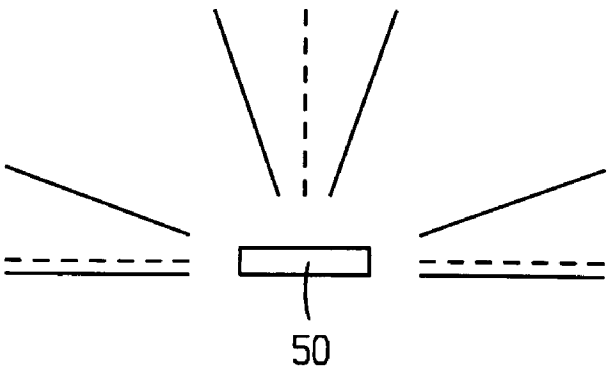
Figure 7A:
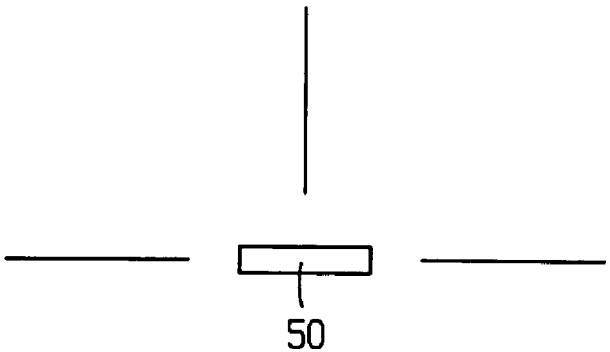

FIGS. 7A–7C depicts the composite visual effect, between the target fixation element of the cumulative axis lines, or cross hairs 10, 20, 30, and the directional, as well as depth sensory, element of the cumulative convergence lines, or margins 10*a*, 10*b*, 20*a*, 20*b*, 30*a*, 30*b*, all of which are incorporated together as unit within unit and form pointers or focal lead lines, as well as focus gathering elements, in the direction of the target. As shown in FIG. 7A, The implicit fixational axis lines are not sufficient to truly focus all visual attention onto the rim 50. As shown in FIG. 7B, the implementation of the stripes or wedges creates a directional depth sensory convergence lines drawn from the edge of each said stripe or wedge. As shown in FIG. 7C, the implicit fixational axis lines within the directional depth sensory converging lines form a super accumulation of focal elements converging on the centered target, or rim 50.

FIGS. 8A–C depict the focal line scattering, specifically FIG. 8A shows the lines projecting from the shot source 70 towards the broader intended target 13. Without the stripes or wedges present it is difficult to channel these lines towards the goal. As shown in FIG. 8C the arch of the shot is guided and stabilized by the gathering and accumulating focal lines created by the application of the stripes or wedges 10, 20 and 30 as shown in FIG. 8B.

Alternative variations may be stripes of other colors, shades, textures, sheens, or such, or any combination thereof. They may be stripes of various angles or convergence gradients, no convergence gradients, or inverse gradients. They may be stripes of various lengths or widths, or combinations thereof. They may stripes of various vertical or horizontal plane situation, or combinations thereof. They may stripes of various slants, or axis lines 10, 20, 30, or combinations thereof. They may be combinations of two or more stripes where preferred embodiment has one, or combinations thereof between the various axis line components. They be any combination of these stripes excluding or including any other of these stripes. They may be any combination of all variations aforementioned, as may be deemed or anticipated suitable or optimal to gathering and concentrating focal lines or visually aiding in ball shooting accuracy in the game of basketball, all of which may be modified, refined, adjusted, adapted or vary depending on, but not limited to, desired blend of efficacy and aesthetic.

There is a widely appreciated phenomenon in basketball that shots from the baseline, or side of the rim, are more daunting to gauge, or fix on, than shots of equal distance from the key, or front of the rim. The target itself, hoop or ring, is circular and therefore is the same from whichever side or angle one views it, thus there should be no cause for said phenomenon other than it's being the backboard's face, which can't be seen from the baseline, that creates an added point of symmetry and fixation and therefore an aid in facilitating accuracy. It may be appreciated that the square within a square visual design of the present basketball backboard is based on a widely prevalent, or even universal, target accessing principle which may be called "tapering" or "phasing in" as it relates to being concentric or fractal. Moreover, this principle is extensively used in many diverse walks of life, among which to state only a few are bulls eye and dartboard markings, infrastructural chains of command and systems of electoral representation. What is missing in the prior art of the specific field of invention is a dartboard's, or a similar product's, outer margin in congruity with a greater target, and a scope's fixation cross hair. The already proven additions of which can only, if anything, aid in enhancement of shooting accuracy. It may also be appreciated that there exists a further phenomenon in basketball that a shot slightly askew from center, meaning askew from the front of the rim, or top of the key, is easier to make than a straight on shot directly from center. In evidence of this, many players even prefer shooting their free throws from slightly askew, or at an angle to the backboard's face other than a right angle, despite the fact that this gives them less backboard surface from which to bank an errant shot into the basket. The main reason for this is presumed to be that from an angle, or a non-right angle, to the backboard, one can better perceive the protrusion of basket from backboard, and thus can better sense it's depth than from straight on where essentially all one sees is basket flush against backboard in non-protruding 2 dimensional perspective. Furthermore it is reasonable to assume that focal lines directed at a 2 dimensional surface or plane, such as backboard, scatter focus to the periphery of that plane, in like manner of droplets on a resistant surface, while focal lines directed at a 3 dimensional surface or simulation thereof, which lends depth perspective, are allowed to better penetrate into the depth field, as if by gravitational pull or absorption, and therefore avoid focal scattering to the periphery along the height and width plane (see FIG. 8). This is suggestive of the addition of not only a linear, or axial, crosshair for guidance to the target but a triangular, wedge-like crosshair that may assist in depth perception from whichever side, angle or direction one views it and subsequently aims the ball (FIG. 7). This adds and establishes not only the axial main components which are the scope-like guidance or fixation crosshairs but, in further departure, their subcomponents which are the converging margins, or fringes, of said cross hairs into depth sensory vanishing point wedges (FIG. 3).

A good mechanical analogy for how the basket wedge is expected to operate is the baseball glove. When baseball was invented, there was no glove and players caught the ball with their bare hands. Then a primitive baseball glove was invented which was merely an extension of a player's fingers to help gather the ball. The basket or rim is like the palm of the bare hand where the ball is supposed to go and the basket wedge is like a 3 finger extension of that hand to help in gathering the ball to the palm (see FIG. 10). Thus it may be stated that the shortcoming or disadvantage of the prior art is the lack of a glove for catching the ball. The principle difference and departure of a basket wedge is that it does not directly gather the ball as a baseball glove does because it is a visual, or virtual, object as opposed to a physical or mechanical one. A visual object cannot directly gather a physical object as a glove, a physical object, gathers a ball, another physical object, but rather a visual object must gather a physical object circuitously or indirectly by first directly gathering another visual object. This is done by way of the basket wedge, a visual object, acting as a homing device, directly gathering, or programming, the lines of focus, another visual object, which in turn gathers, or programs, the mind, a visual object and nexus to the physical, which then in turn gathers, or programs, the hands and body, a physical object, which then further in turn gathers or programs the ball, or it's trajectory into the target. And in this manner, namely the wedge programming the eye, the eye programming the brain, the brain programming the body, and the body programming the ball, a visual object, namely the basket wedge, indirectly gathers or programs a physical object, namely a basketball. It may be stated that the virtual gathering fingers of the basket wedge are indirectly programming the real fingers of the hand. Thus though the ball is not actually gathered by this visual glove, as a baseball by a baseball glove, the focal lines that programmed the ball's flight were gathered from, or themselves programmed, by it. This type of memory bank pre-programming, and indirect causality, is to a great extent how automatic physical functions, such as operating a machine or instrument, which any ball or projectile essentially is, are learned and carried out. More simply stated, a visual object can act on, or gather, a visual object directly and a physical object can act on, or gather, a physical object directly, but a visual object cannot act on a physical object directly and vice versa, but rather they may act on each other indirectly through some intermediate nexus, and that is essentially what the use of this device facilitates. As the baseball glove generally acts on the ball directly, the basket wedge, gathering a free flying object by having already gathered, or programmed, it, acts the same way on the ball, but indirectly. Moreover, the analogy of 3 stripes incorporating themselves into 1 cohesive unit, as in 3 fingers of a glove, is itself analogous, in conjunction namely with the invention's main objective of improved long range shooting, to a forest or a painting, whereby neither can be seen as a cohesive whole from close range, but rather must be viewed from a distance, or long range, as in long range shooting, in order to be appreciable or effective as more than parts, or pixels in the case of a painting, as this particular concept is pictorially expressed in the euphemism "not seeing the forest for the trees", the trees in this case being the stripes, the stripes being most appreciable as a focal aid from long range.

In further, general and systematic summary description of the invention: 1) The main objective of the idea is to improve long range shooting accuracy in the game of basketball and thereby improve it's level of appeal. 2) It is intended for the use of anyone who plays or follows the game of basketball. 3) It achieves its purpose by better focusing the shooter on his or her target. 4) Its advantage over any known product is the addition of a depth sensory aid, a triangulation aid, a relaxation aid, and possibly an extra concentric tapering aid. 5) It's unique features are a triangulating cross hair marking around the target where each line of the cross may be wedge shaped for the purpose of further narrowing a shooter's focus and also serving as a possible depth sensory mechanism, and possibly an outer concentric square, or outline, which runs along the outer edge of the entire backboard, lending the concentric, or tapering, effect of a dartboard-like target. 6) Idea works generally on the cumulative effect of the a) tapering, b) triangulation, c) vanishing point, and d) coordinated linear accumulation principles: i) The tapering principle works by using concentric squares, as well as possibly colors, to focus a shooter's aim a step at a time until he zeroes in on the final target. The shooter's aim is focused incrementally but instantaneously due to the fact that it is second nature subliminal, or automatic, as opposed to deliberate. ii) The triangulation principle works by guiding, gathering, or drawing the shooter's focus to the center and crossing point of a cross's or partial cross's lines of dimension from their extremities. iii) The vanishing point principle works by presenting the sensation of 3 dimensionality with anything that is wedge shaped, narrowing, or has a vanishing point (often applied in portraiture and art in general). iv) The coordinated linear accumulation principle works by a concentrated, unified accumulation of super-linear and sub-linear visual components, in correlation with a bold, complimentary color, all directing and guiding toward one centrally fixed and prominent area (FIG. 7).

It should be understood that the foregoing relates to preferred embodiments of the invention and that modifications may be made without departing from the spirit and scope of the invention as set forth in the following claims.

We claim:

1. An improved accuracy backboard apparatus comprising:

a backboard;

a goal in fixed communication with said backboard;

an indicia on a front of said backboard forming a complete left triangle having a first side, second side and third side, wherein said first side of said left triangle is adjacent to the left edge of said backboard and said second side and said third side converge to a point ending at said goal so as to visually aid a player; and an indicia on a front of said backboard forming a complete right triangle having a first side, second side and third side, wherein said first side of said right triangle is adjacent to the right edge of said backboard and said second side and said third side converge to a point ending at said goal so as to visually aid a player.

2. An apparatus as in claim 1, wherein said left triangle is the mirror image of said right triangle.

3. An improved accuracy backboard apparatus comprising:

a backboard;

a goal in fixed communication with said backboard;

an indicia on a front of said backboard forming a complete left triangle having a first side, second side and third side, wherein said first side of said left triangle is adjacent to the left edge of said backboard and said second side and said third side converge to a point ending at said goal so as to visually aid a player; and an indicia on a front of said backboard forming a complete right triangle having a first side, second side and third side, wherein said first side of said right triangle is adjacent to the right edge of said backboard and said second side and said third side converge to a point ending at said goal so as to visually aid a player.

4. An apparatus as in claim 3, wherein said left triangle is the mirror image of said right triangle.

5. An improved accuracy backboard apparatus comprising:

a backboard having an outer concentric square having at least one edge along an edge of said backboard and an inner concentric square;

a goal in fixed communication with said backboard and abutting said inner concentric square;

an indicia on a front of said backboard forming a complete left triangle having a first side, second side and third side, wherein said first side of said left triangle is adjacent to the left edge of said backboard and said second side and said third side converge to a point ending at said goal so as to visually aid a player; and an indicia on a front of said backboard forming a complete right triangle having a first side, second side and third side, wherein said right triangle is the mirror image of said left triangle and said first side of said right triangle is adjacent to the right edge of said backboard and said second side and said third side converge to a point ending at said goal so as to visually aid a player.

6. An apparatus as in claim 5, wherein said inner concentric square abuts at least one of said left triangle, said top triangle and said right triangle.

7. An apparatus as in claim 5, wherein said outer concentric square abuts at least one of said left triangle, said top triangle and said right triangle.

* * * * *